US008175493B2

(12) United States Patent
Peckjian

(10) Patent No.: US 8,175,493 B2
(45) Date of Patent: May 8, 2012

(54) TONER CARTRIDGE HAVING MAGNETIC COUPLING

(75) Inventor: Bryan Peckjian, Huntingdon Valley, PA (US)

(73) Assignee: Katun Corporation, Minneapolis, MN (US)

( * ) Notice: Subject to any disclaimer, the term of this patent is extended or adjusted under 35 U.S.C. 154(b) by 495 days.

(21) Appl. No.: 12/077,748

(22) Filed: Mar. 21, 2008

(65) Prior Publication Data

US 2009/0238604 A1 Sep. 24, 2009

(51) Int. Cl.
*G03G 15/08* (2006.01)

(52) U.S. Cl. ..... 399/120; 399/119; 399/254

(58) Field of Classification Search ..... 399/120
See application file for complete search history.

(56) References Cited

U.S. PATENT DOCUMENTS 7,272,346 B2 9/2007 Ito
2003/0196294 A1* 10/2003 Conrad ..... 15/331
2006/0067735 A1* 3/2006 Sanada et al. ..... 399/120
2006/0210412 A1* 9/2006 Lawyer et al. ..... 417/420
* cited by examiner

*Primary Examiner* — David Gray
*Assistant Examiner* — Roy Y Yi
(74) *Attorney, Agent, or Firm* — Schwegman, Lundberg & Woessner, P.A.

(57) ABSTRACT

A toner cartridge having a magnetically coupled drive apparatus is provided. The cartridge provides a first toner holding member that houses toner and a second toner holding member adjacent to the first member that houses toner. A dividing wall separates the first toner holding member from the second toner holding member. A toner shifting component shifts the waste toner housed in the first toner holding member and a toner stirring component stirs the fresh toner housed in the second toner holding member. The toner shifting component and toner stirring component are magnetically coupled through the dividing wall so that when the toner stirring component rotates the toner shifting component rotates. The magnetic coupling disposed between the toner shifting component and toner stirring component engages without an opening through the dividing wall. As a result, waste toner cannot pass through the dividing wall into the fresh toner housing and vice versa.

20 Claims, 8 Drawing Sheets

TONER CARTRIDGE HAVING MAGNETIC COUPLING

FIELD OF THE INVENTION

The present invention generally relates to a laser toner cartridge and in particular, a laser toner cartridge having magnetically coupled toner stirring and shifting members.

BACKGROUND OF THE INVENTION

The present invention provides a solution to one of the major problems in the design of laser toner cartridges. Fabricating toner cartridges that do not leak toners between areas that should be isolated are very difficult tasks for engineers. Special seals designed to prohibit the migration of toner within and out of the cartridge are costly to fabricate and difficult to assemble. These costly seals are designed to work with specially contoured plastics to insure leak free joints and couplings. The present invention solves this problem by providing a magnetically coupled drive apparatus that needs no costly seals or specially designed plastic components but, does prohibit the migration of toner across the necessary areas of isolation.

SUMMARY OF THE INVENTION

Briefly, the present invention provides a toner cartridge that has a magnetic coupling for use in a xerographic device. The cartridge includes a first toner holding member that houses toner therein, a second toner holding member that is adjacent to the first member which also houses toner therein, a dividing wall that separates the first toner holding member from the second toner holding member, a toner shifting component that shifts the toner housed in the first toner holding member, a toner stirring component that stirs the toner housed in the second toner holding member. The toner shifting component and toner stirring component are magnetically coupled through the dividing wall so that when the toner stirring component rotates the toner shifting component also rotates. The magnetic coupling between the toner shifting component and toner stirring component engages without an opening through the dividing wall.

In another aspect, the toner shifting component has a first magnet that is disposed thereon and the toner stirring component has a second magnet that is disposed thereon. The first and second magnets are oriented and positioned to attract one another.

In another aspect, one of the toner shifting component or toner stirring component has a magnet disposed thereon and the other has a ferrous material disposed thereon. The magnet and ferrous material are oriented and positioned to attract one another.

In another aspect, the toner shifting component provides a first plurality of magnets disposed within and the toner stirring component provides a second plurality of magnets disposed within. The first and second plurality of magnets are oriented and positioned to attract one another.

In another aspect, the toner shifting component has an annular recess and the toner stirring component has an annular recess. The dividing wall has a first protrusion on a first side that corresponds to the annular recess on the toner shifting component and a second protrusion on a second side that corresponds to the annular recess on the toner stirring component. Here, the annular recesses of the toner shifting component and toner stirring component are free to rotate about the first and second dividing wall protrusions.

In another aspect, the toner shifting component has an annular post and the toner stirring component has an annular post. The dividing wall has a first annular hub on a first side that corresponds to the annular post on the toner shifting component and a second annular hub on a second side that corresponds to the annular post on the toner stirring component. Here, the toner shifting component and toner stirring component are free to rotate about the first and second annular hubs.

In another aspect, the cartridge includes a first toner holding member that houses toner therein, a second toner holding member that is adjacent to the first member which also houses toner therein, a dividing wall that separates the first toner holding member from the second toner holding member, a toner shifting component that shifts the toner housed in the first toner holding member, a toner stirring component that stirs the toner housed in the second toner holding member. The toner shifting component and toner stirring component are magnetically coupled through the dividing wall so that when the toner shifting component rotates the toner stirring component also rotates. The magnetic coupling between the toner shifting component and toner stirring component engages without an opening through the dividing wall.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings. As should be understood, however, the invention is not limited to the precise arrangements and instrumentalities shown. In the drawings.

DETAILED DESCRIPTION OF ILLUSTRATIVE EMBODIMENTS

Figure 1:
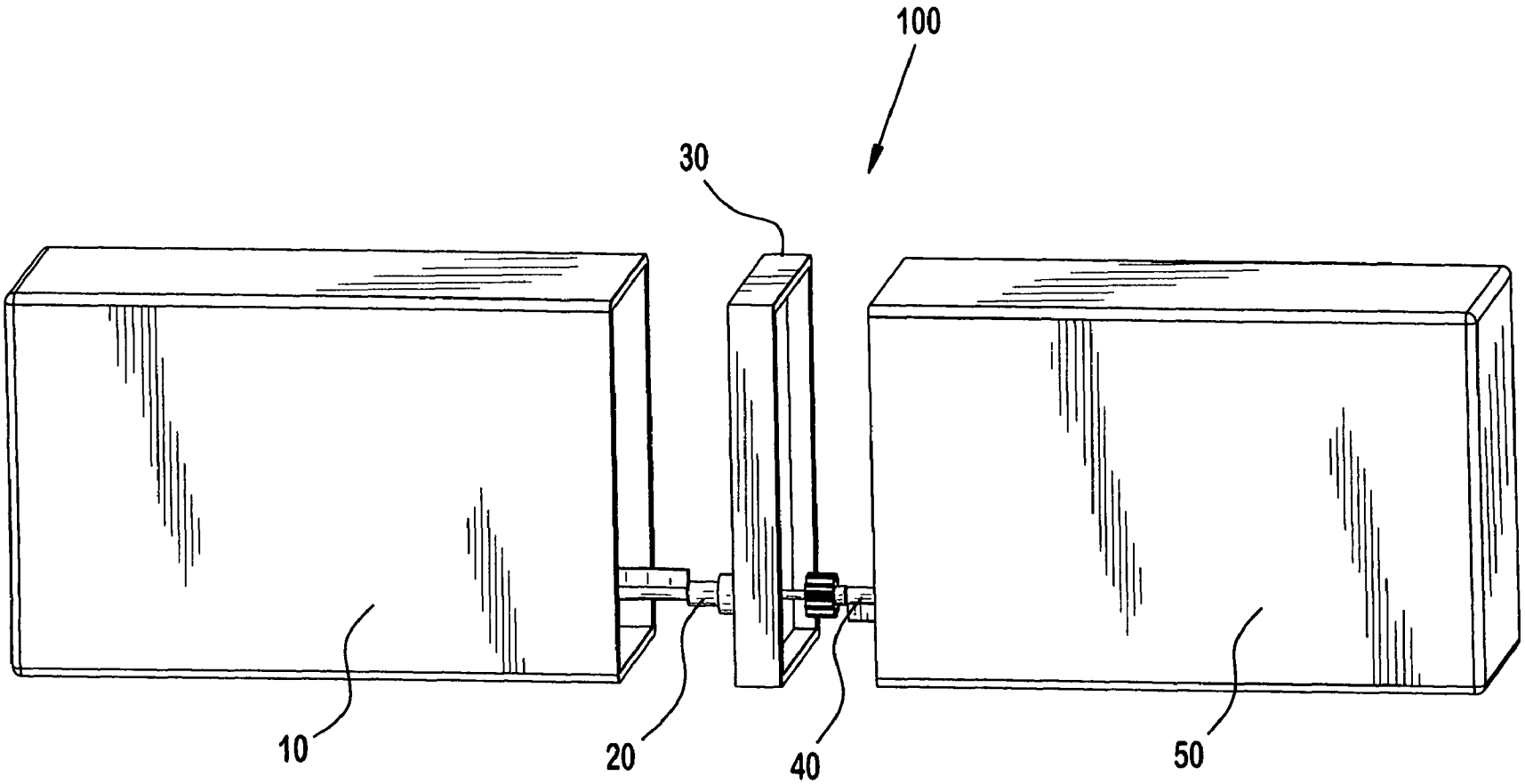
FIG. 1 is an elevated perspective view of a preferred embodiment of the toner cartridge of the present invention.

In the following description, for purposes of explanation and not limitation, specific details are set forth, such as particular toner cartridge housings, shifters, stirrers, dividing walls, magnetic couplings, etc. in order to provide a thorough understanding of the present invention. However, it will be apparent to one skilled in the art that the present invention may be practiced in other embodiments that depart from these specific details. Also, certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the designated parts thereof. The terminology includes the words above specifically mentioned, derivatives thereof and words of similar import.

Basic Cartridge Design

There is shown in FIG. 1 a basic toner cartridge assembly 100 according to a preferred embodiment of the present invention. Cartridge assembly 100 includes a first toner holding member 10 that houses toner (not shown) therein and a second toner holding member 50 that is adjacent to the first member 10. The second toner holding member 50 also houses toner (not shown) therein. The first toner holding member 10 and second toner holding member 50 are shown as being rectangular in shape. However, they are typically components that are formed to fit within a xerographic device. Consequently, the components of the cartridge assembly 100 need not be fixed to particular shape. Size depends on the physical dynamics of the xerographic device as well. Hence, depending on the physical size and layout of the xerographic device, the size and shape of the first and second toner holding members will vary accordingly.

The first toner holding member 10 is generally configured to provide an area for collecting waste toner. Conversely, the second toner holding member 50 is generally configured to provide a storage area for fresh toner. In the present embodiment, toner is generally fed out of the second toner holding member 50 and is processed through the printer or xerographic device (not shown). The untransferred or waste toner is then generally fed back into the waste toner holding member 10 through a drum unit (not shown) in the xerographic device for storage.

Figure 2:
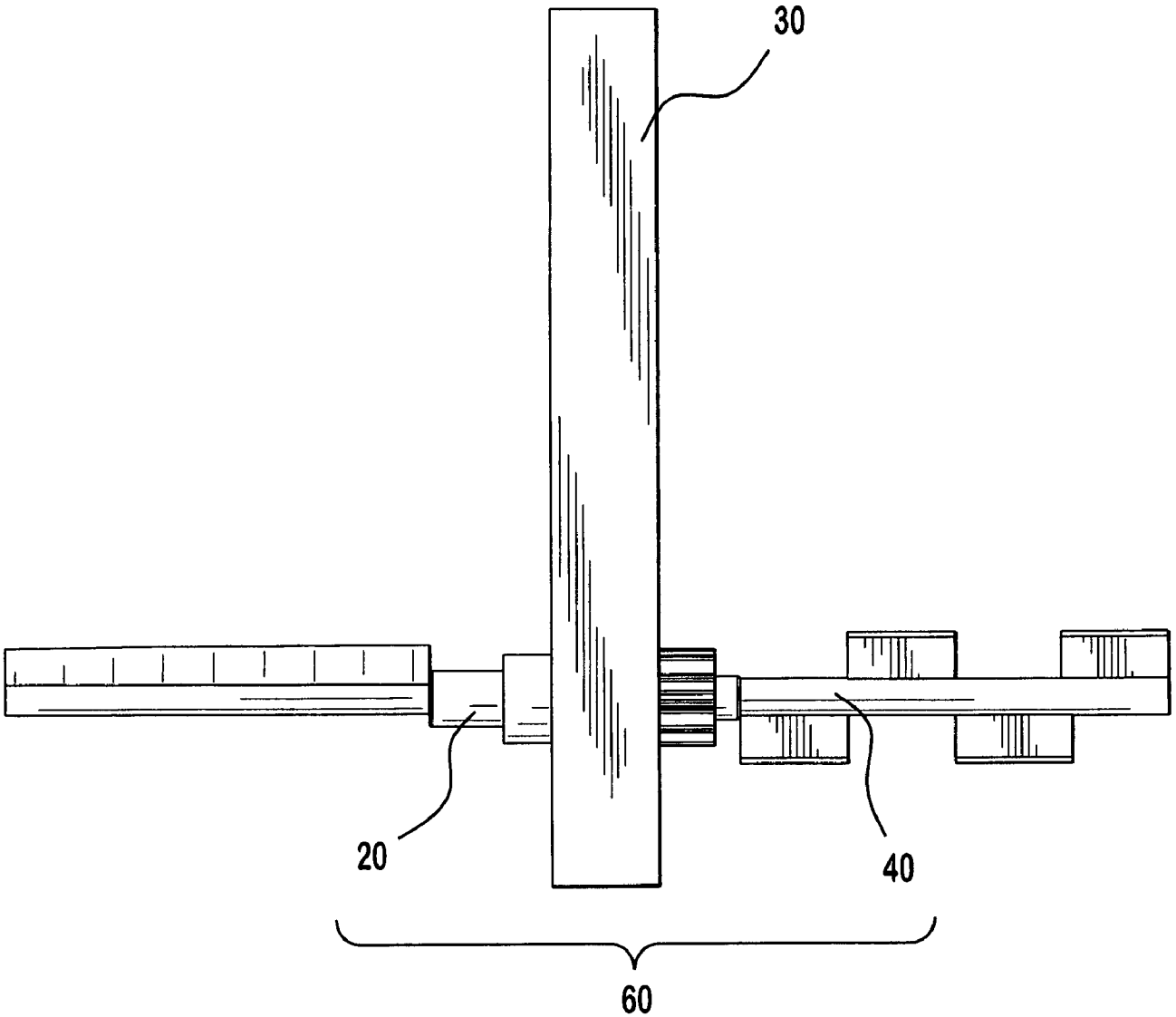
FIG. 2 is a perspective view of a magnetic coupling assembly housed within the toner cartridge of the present invention.

Now referring to FIGS. 1 and 2, cartridge assembly 100 provides a toner shifting component 20 that typically shifts the waste toner housed in the first toner holding member 10. The toner entering into the waste toner holding member 10 must be kept moving or shifting so that the toner does not block the entrance (not shown). In the present embodiment, the toner shifting component 20 employs a gently curved blade that, when rotated, shifts the toner. Various other types of toner shifting component configurations could be employed to move the toner such as a spiral auger, blade or cork screw.

Cartridge assembly 100 further provides a toner stirring component 40 that stirs the toner housed in the second toner holding member 50. The toner stirring component 40 shown in FIG. 2 is a paddle. Various other types of toner stirring component configurations could be employed to stir the toner such as a bar, wire or blade. The toner must be stirred during usage so that it flows freely and evenly into the drum unit. This is because the toner can settle during shipping and storage.

Cartridge assembly 100 further includes a dividing wall 30 that separates the first toner holding member 10 from the second toner holding member 50. The toner shifting component 20 and the toner stirring 40 component are magnetically coupled 60 together through the dividing wall 30 so that when the toner stirring component 40 is driven to rotate the toner shifting component 20 also rotates. The magnetic coupling 60 between the toner shifting component 20 and toner stirring component 40 engages without any opening through the dividing wall 30. This is very important and is at the heart of the instant invention because, preventing toner leakage in toner cartridges is very difficult to accomplish and every joint that requires a seal is a potential leak site. Consequently, since there is no opening in the dividing wall 30 to link the toner shifting 20 and toner stirring 40 components, then there can be no leakage.

Acrylonitrile Butadiene Styrene (ABS) plastic is a preferred material to be used in the injection forming process for the first and second toner holding members 10 and 50 and toner shifting and stirring components 20 and 40. However, those skilled in the art will recognize that any type of injection moldable plastic could be used such as Delran, Teflon®, Nylon®, Polystyrene, Rayon, Polyethylene, Acrylic or blends thereof. The dividing wall 30 is also typically an injection molded component that is made from one of the above disclosed materials.

In an alternate embodiment, the first and second toner holding members 10 and 50 are reversed in orientation with respect to one another. In this embodiment, the first toner holding member acts as the fresh toner holding area and the second toner holding member acts as the waste toner area.

Figure 3:
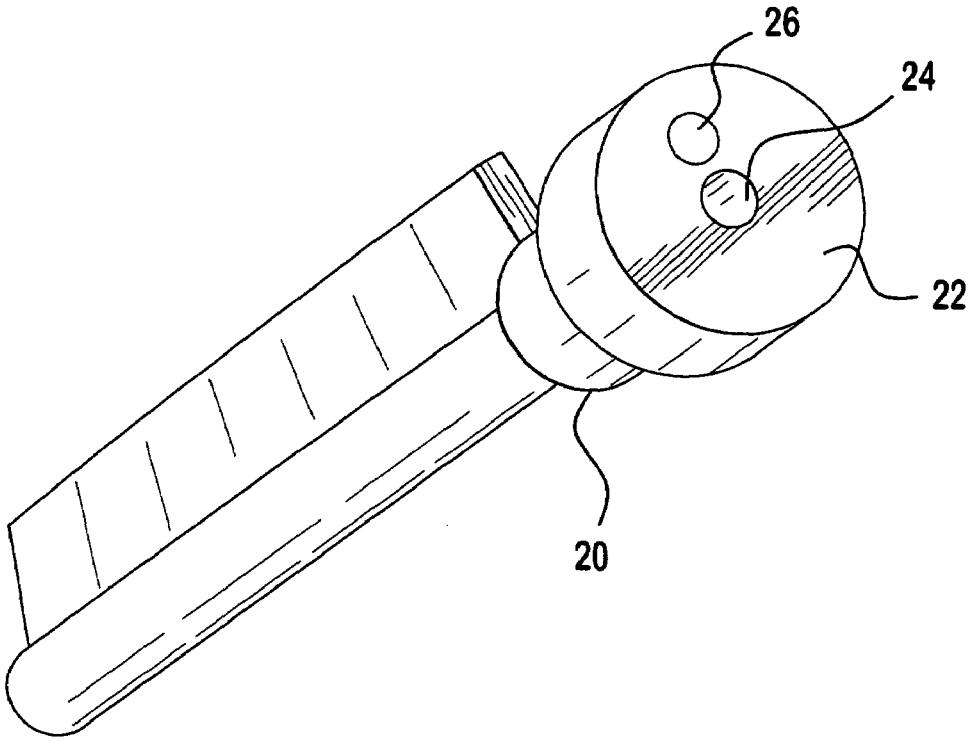
FIG. 3 is an elevated perspective view of a toner shifting component of the present invention.
Figure 4:
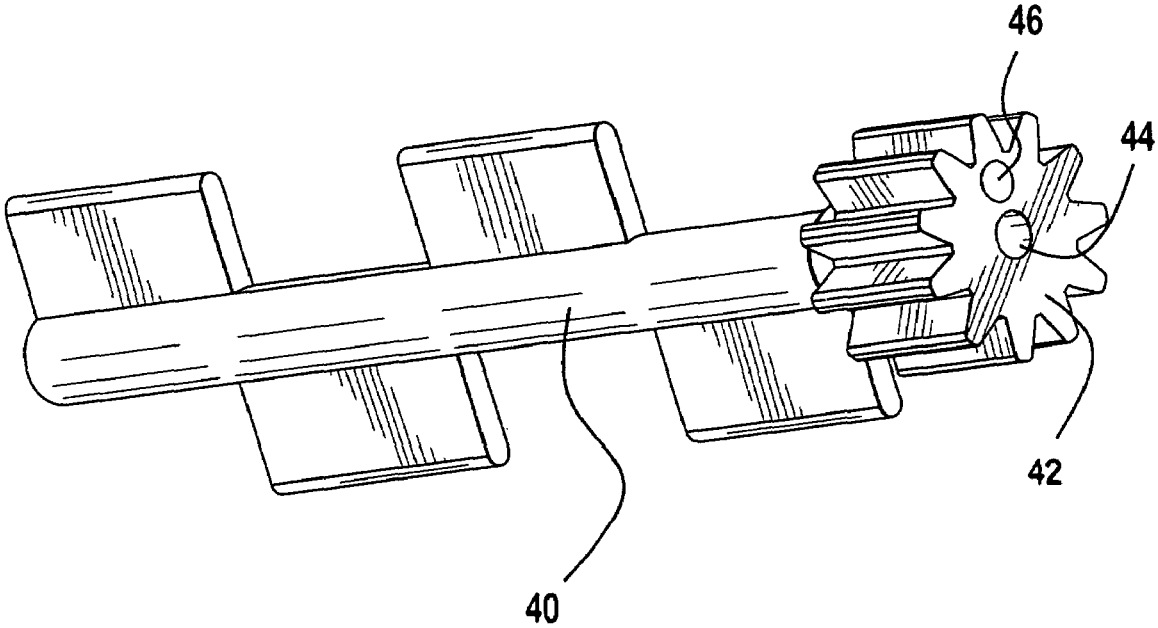
FIG. 4 is an elevated perspective view of a toner stirring component of the present.
Figure 5:
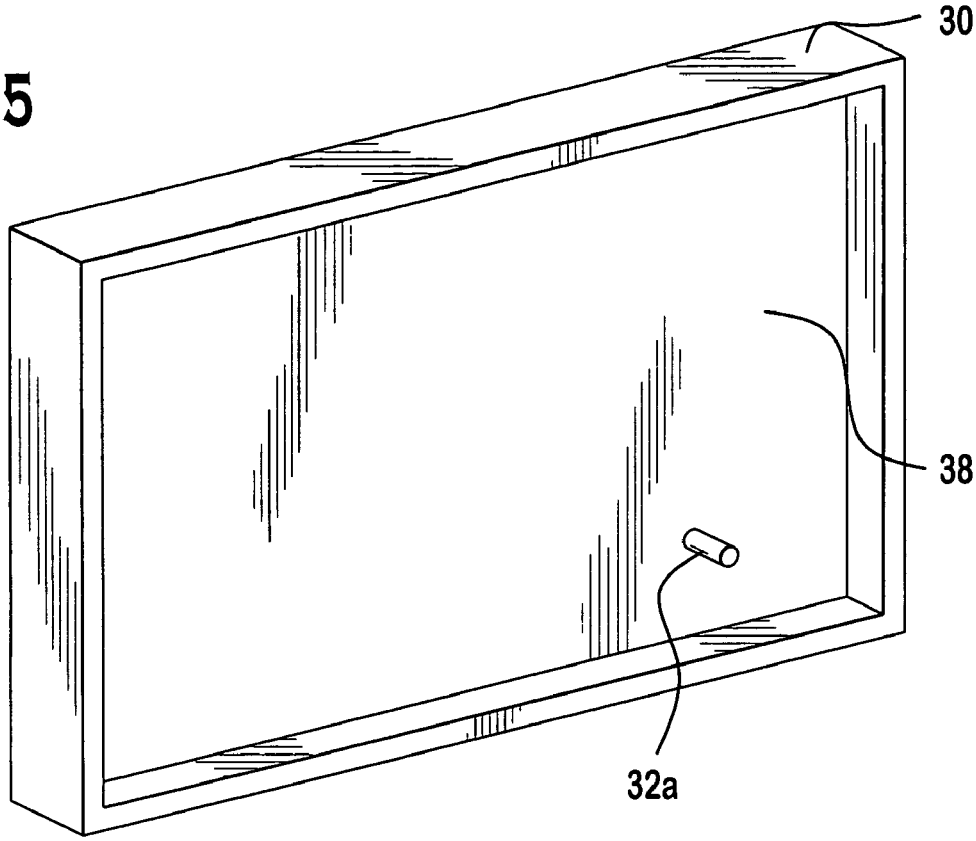
FIG. 5 is a first perspective view of a dividing wall of the present invention.
Figure 6:
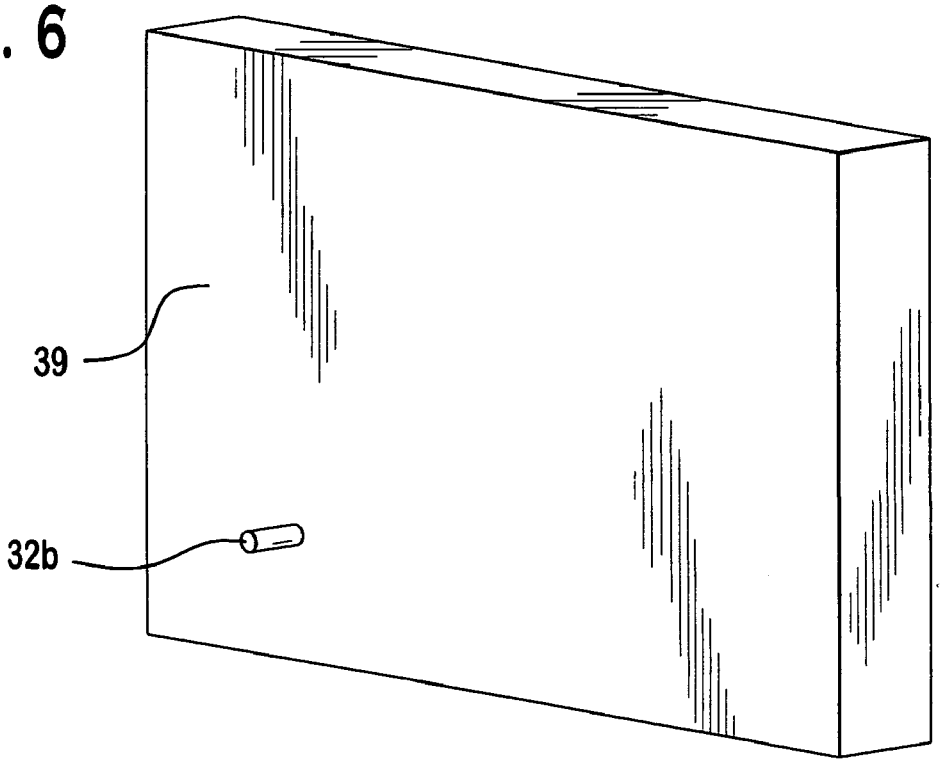
FIG. 6 is a second perspective view of the dividing wall of the present invention.

Referring now to FIGS. 3 and 4, the toner shifting component 20 has a hub 22 with a first magnet 26 disposed therein. Similarly, the toner stirring component 40 also has a hub 42 with a second magnet 46 disposed therein. Magnet 26 and magnet 46 are positioned and oriented to attract one another. That is, the magnetic poles are longitudinally aligned with one another and are opposite in polarity. Magnets 26 and 46 could be square, oval, diamond, rectangular, hexagonal or any other shape that fits within the dynamics required by the toner cartridge assembly 100 to drive the toner shifting and stirring components. The size of the magnet selected will depend on the weight of the toner shifting component 20, the weight of the toner stirring component 40, the amount of toner to be moved in the waste toner holding member 10 and any frictional loses in the assembly.

Neodymium magnets (chemical formula: $Nd_2Fe_{14}B$) or rare earth magnets are a preferred choice for this application because they exhibit extreme strength for their small size and are relatively inexpensive. Rare earth magnets are offered for sale by numerous companies. One exemplary company that sells Neodymium magnets is Amazing Magnets®, located at 3943 Irvine Blvd #92, Irvine, Calif. 92602 and may be contacted over the Internet at sales@amazingmagnets.com. Another example is Master Magnets, Inc. located at 747 South Gilbert Street, Castle Rock, Colo. and may be contacted over the Internet at weblead@magnetsource.com In another embodiment, the magnet could be a ferrite type magnet. Ferrite magnets are offered for sale by Indigo® Instruments, 169 Lexington Court, Unit I, Waterloo, ON and may be contacted over the Internet at info@indigo.com.

In another embodiment, the magnet could be a steel bar type magnet. Steel bar type magnets are offered for sale by Ward's Natural Science Establishment, LLC 5100 West Henrietta Road, P.O. Box 92912, Rochester, N.Y. and may be contacted over the Internet at http://wardsci.com.

In another embodiment, one of the magnets or could be replaced by a ferrous material such as a piece of iron or steel. In this embodiment, the strength of the coupling would be reduced because only one side of the coupling is magnetic. However, a stronger magnet could be selected to compensate for the single magnet configuration and the combination would still produce a functional magnetic coupling.

The thickness and type of the material used in the dividing wall 30 impacts the magnetic strength of the coupling as well. The thickness of the material used for the dividing wall 30 should be as thin as possible. The strength of the magnetic coupling varies exponentially with the distance between the magnets. Consequently, the closer the magnets 26 and 46 are located with respect to one another the stronger the magnetic coupling will be. As the distance between the magnets increases, the strength of the coupling falls off dramatically. As such, it is important to configure the dividing wall 30 to be as thin as possible so that the magnets are disposed as close as possible with respect to each other. Also, the type of material used to fabricate the dividing wall 30 is critical to the performance of the magnetic coupling. As such, the dividing wall 30 should preferably be made from plastic or some other type of non-magnetic material that will not affect the coupling.

Now referring to FIGS. 2, 3, 4, 5 and 6, hub 22 includes an annular recess 24 that extends inward into the toner shifting component 20. Additionally, hub 42 has an annular recess 44 that extends inward into the toner stirring component 40. The dividing wall 30 has a first protrusion 32*a* on a first side 38 that corresponds to the annular recess 44 on the toner stirring component 40 and a second protrusion 32*b* on a second side 39 that corresponds to the annular recess 24 on the toner shifting component 20. Consequently, the toner shifting component 20 and toner stirring component 40 are free to rotate and be driven about the first and second protrusions 32*a* and 32*b*.

Figure 7:
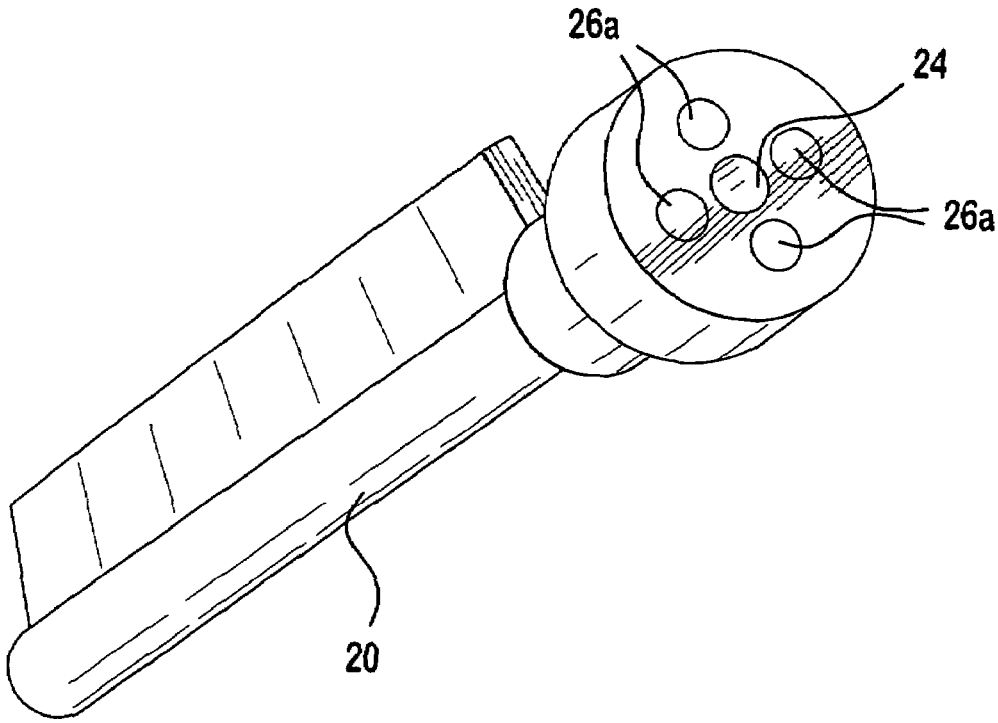
FIG. 7 is an elevated perspective view of an alternate embodiment of the toner shifting component of the present invention.
Figure 8:
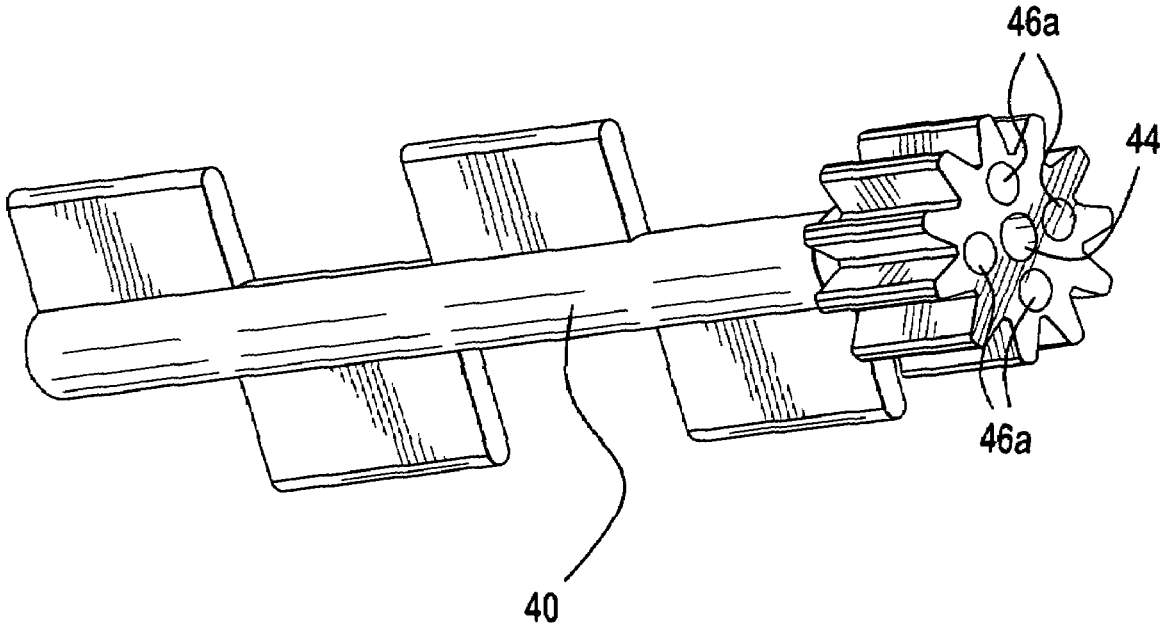
FIG. 8 is an elevated perspective view of an alternate embodiment of the toner shirring component of the present invention.

Now referring to FIGS. 7 and 8 the first magnet 26 may further provide a plurality of magnets 26*a* disposed within the toner shifting component 20 and the second magnet 46 may further provide a plurality of magnets 46*a* disposed within the toner stirring component 40. Here, with the four magnets 26*a* and 46*a* the strength of the magnetic coupling is greatly increased. The number of magnets is a design consideration that again depends on the physical parameters of the cartridge assembly. As such, the number of magnets that comprise the magnetic coupling is not limited to a specific number or quantity.

In an alternate embodiment of the magnetic coupling (not shown), the toner shifting component and toner stirring component may be configured through the dividing wall 30 such that when the toner shifting component 40 is driven to rotate the toner stirring component 20 also rotates. Hence, this embodiment's drive configuration is opposite to the embodiment of disclosed in FIGS. 1-7. In essence, it does not matter which of the two components is driven first as long as when one of either the toner shifting component or toner stirring component is driven, the other is driven to rotate by the magnetic coupling as well.

Figure 9:
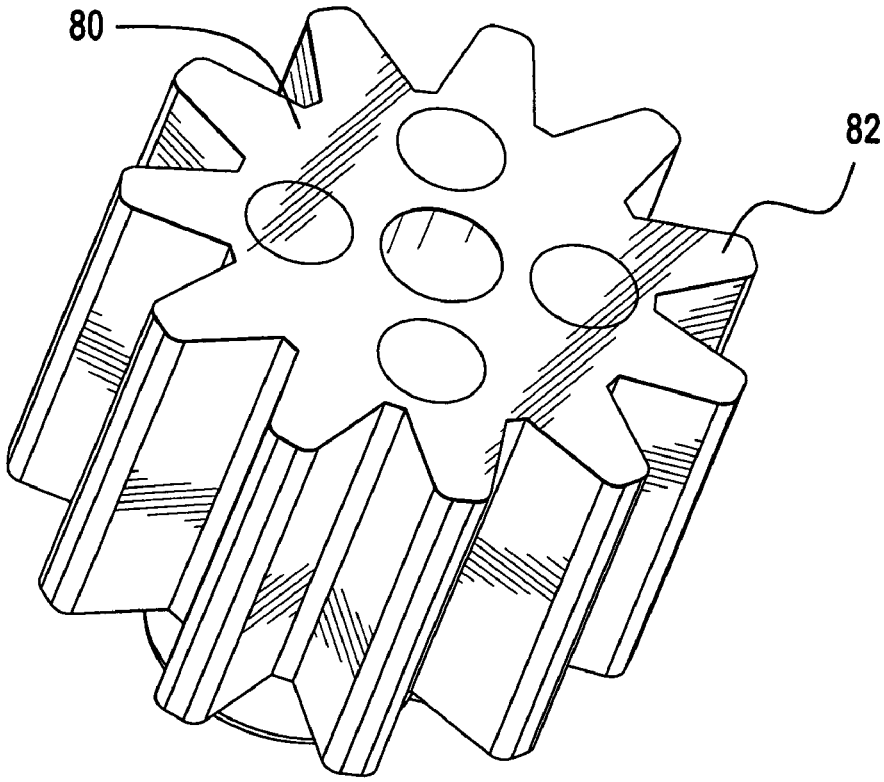
FIG. 9 is an elevated perspective view of an alternate embodiment of a hub of the present invention.
Figure 10:
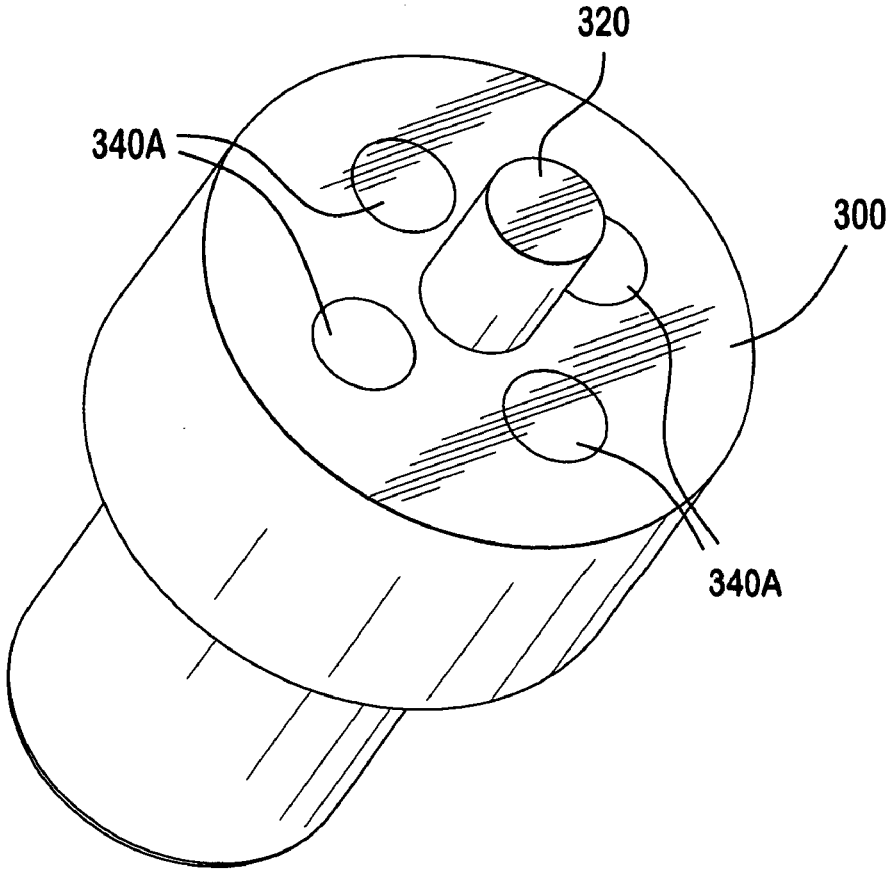
FIG. 10 is an elevated perspective view of an alternate embodiment of a toner shifting component of the present invention.
Figure 11:
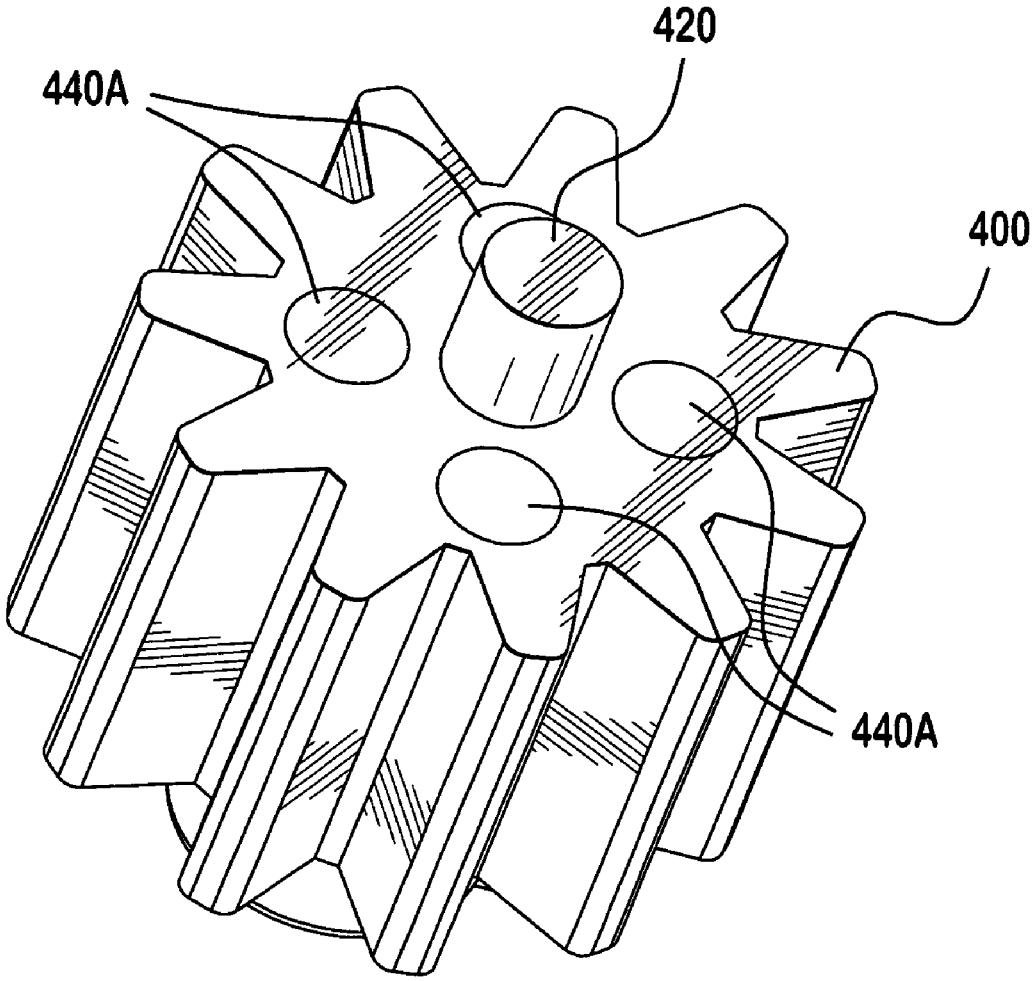
FIG. 11 is an elevated perspective view of an alternate embodiment of a toner shirring component of the present invention.
Figure 12:
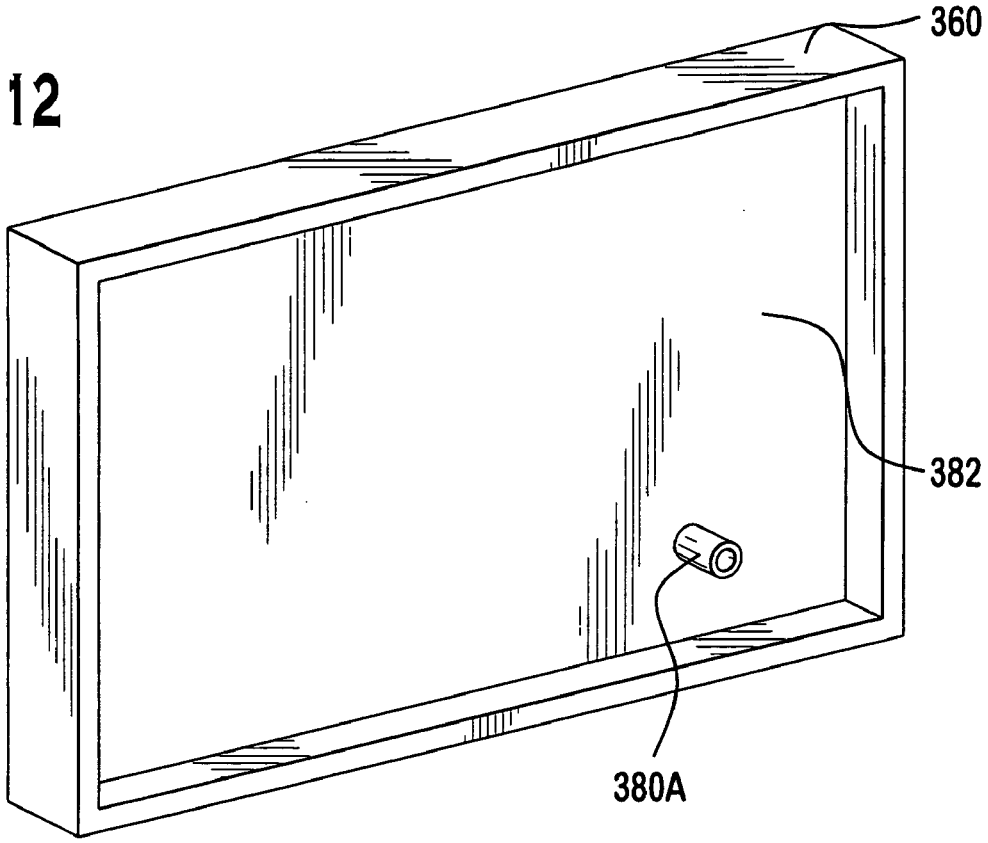
FIG. 12 is a first perspective view of an alternate embodiment of a dividing wall of the present invention.
Figure 13:
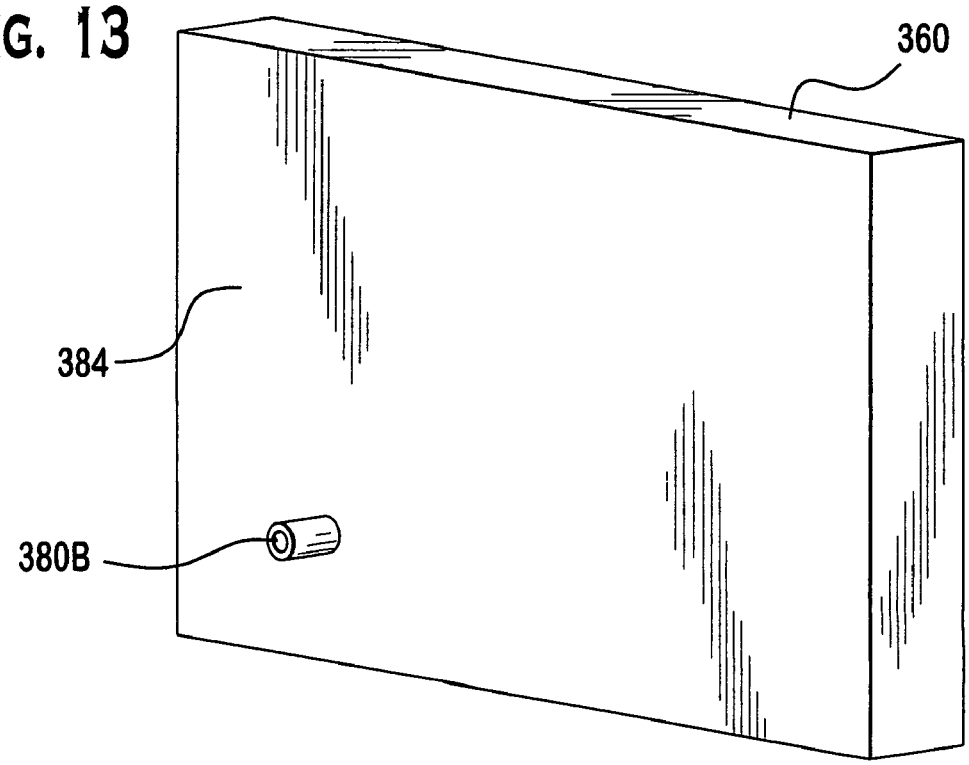
FIG. 13 is a second perspective view of an alternate embodiment of a dividing wall of the present invention.

In a further embodiment, either one of the toner shifting or toner stirring components may be driven by an external gear. FIG. 9 shows a hub 80 having teeth like a gear that could be disposed on either one of toner shifting or toner stirring components. Hub 80 could be driven by another gear (not shown) that is coupled to one of the toner shifting or toner stirring components. Here again, it does not matter which of the two components is driven by the external gear as long as when one of either the toner shifting component or toner stirring component is driven, the other is driven to rotate through the magnetic coupling as well.

There is shown in FIGS. 10, 11, 12 and 13 a further embodiment of a magnetic coupling. Everything in this embodiment is the same as disclosed above and shown in FIGS. 1-7 except that the toner shifting component 300 has an annular post 320 and the toner stirring component 400 has an annular post 420 rather than respective annular recesses. In this embodiment, the dividing wall 360 has a first annular hub 380*a* on a first side 382 and a second annular hub 380*b* on a second side 384. The first annular hub 380*a* corresponds to the annular post 420 on the toner stirring and the second annular hub 380*b* corresponds to the annular post 320 on the toner shifting component 300. Here, the toner shifting component 300 and toner stirring component 400 are free to rotate about the first and second annular hubs 380*a* and 380*b*.

What is claimed is:

1. A toner cartridge comprising:

a first toner holding member housing toner therein;

a second toner holding member adjacent to the first toner holding member housing toner therein;

a dividing wall separating the first toner holding member from the second toner holding member;

a toner shifting component that shifts the toner housed in the first toner holding member;

a toner stirring component that stirs the toner housed in the second toner holding member;

wherein the toner shifting component and toner stirring component are magnetically coupled through the dividing wall so that when the toner stirring component rotates the toner shifting component also rotates, the toner shifting component and toner stirring component each include at least one magnet, and each of the at least one magnets is positioned within one of the toner shifting component and the toner stirring component, respectively, of the first and second toner holding members; and wherein the magnetic coupling between the toner shifting component and toner stirring component engage without an opening through the dividing wall.

2. The toner cartridge according to claim 1 wherein the toner shifting component has a first magnet disposed thereon and the toner stirring component has a second magnet disposed thereon and wherein the first and second magnets are oriented and positioned to attract one another.

3. The toner cartridge according to claim 1 wherein one of the toner shifting component or toner stirring component has a magnet disposed thereon and the other has a ferrous material disposed thereon and wherein the magnet and ferrous material are oriented and positioned to attract one another.

4. The toner cartridge according to claim 1 wherein the toner shifting component comprises a first plurality of magnets disposed within and the toner stirring component comprises a second plurality of magnets disposed within and wherein the first and second plurality of magnets are oriented and positioned to attract one another.

5. The toner cartridge according to claim 1 wherein the toner shifting component has an annular recess and wherein the toner stirring component has an annular recess.

6. The toner cartridge according to claim 5 wherein the dividing wall has a first protrusion on a first side that corresponds to the annular recess on the toner shifting component and a second protrusion on a second side that corresponds to the annular recess on the toner stirring component and wherein the annular recesses of the toner shifting component and toner stirring component are free to rotate about the first and second dividing wall protrusions.

7. The toner cartridge according to claim 1 wherein the toner shifting component has an annular post and wherein the toner stirring component has an annular post.

8. The toner cartridge according to claim 7 wherein the dividing wall has a first annular hub on a first side that corresponds to the annular post on the toner shifting component and a second annular hub on a second side that corresponds to the annular post on the toner stirring component and wherein the toner shifting component and toner stirring component are free to rotate about the first and second annular hubs.

9. A toner cartridge comprising:

a first toner holding member configured to house toner therein;

a second toner holding member adjacent to the first toner holding member configured to house toner therein;

a partition that separates the first toner holding member from the second toner holding member;

a toner shifting component that shifts the toner housed in the first toner holding member;

a toner stirring component that stirs the toner housed in the first toner holding member, wherein the toner shifting component and the toner stirring component are magnetically coupled through the partition so that when the toner shifting component rotates the toner stirring component also rotates, the toner shifting component and the toner stirring component each include at least one magnet, and each of the at least one magnets is positioned within one of the toner shifting component and the toner stirring component, respectively, of the first and second toner holding members; and wherein the magnetic coupling between the toner shifting component and toner stirring component provides engagement without an opening through the dividing wall.

10. A magnetic coupling for use in a toner cartridge, configured to house toner therein, the magnetic coupling comprising:

a toner shifting component configured for shifting the toner housed within the toner cartridge, the toner shifting component including a shifting component shaft;

a toner stirring component configured for stirring the toner housed within the toner cartridge, the toner stirring component including a stirring component shaft;

at least one magnet disposed within each of the toner shifting component and the toner stirring component, the at least one magnet within the toner shifting component is immediately adjacent to the shifting component shaft, and the at least one magnet within the toner stirring component is immediately adjacent to the stirring component shaft;

a dividing wall disposed between the toner shifting component and the toner stirring component; and wherein the at least one magnet disposed within the toner shifting component and the at least one magnet disposed within the toner stirring component are magnetically coupled together through the dividing wall.

11. The magnetic coupling according to claim 10 wherein an outer peripheral edge of each of the at least one magnets is immediately adjacent to the respective shifting component shaft or the stirring component shaft.

12. The magnetic coupling according to claim 10 wherein the at least one magnet of the toner shifting component includes a first plurality of magnets disposed within, and the at least one magnet of the toner stirring component includes a second plurality of magnets disposed within and wherein the first and second plurality of magnets are oriented and positioned to attract one another.

13. The magnetic coupling according to claim 10 wherein the toner shifting component has an annular recess and wherein the toner stirring component has an annular recess.

14. The magnetic coupling according to claim 13 wherein the dividing wall has a first protrusion on a first side that corresponds to the annular recess on the toner shifting component and a second protrusion on a second side that corresponds to the annular recess on the toner stirring component and wherein the annular recesses of the toner shifting component and toner stirring component are free to rotate about the first and second dividing wall protrusions.

15. The magnetic coupling according to claim 10 wherein the toner shifting component has an annular post and wherein the toner stirring component has an annular post.

16. The magnetic coupling according to claim 15 wherein the dividing wall has a first annular hub on a first side that corresponds to the annular post on the toner shifting component and a second annular hub on a second side that corresponds to the annular post on the toner stirring component and wherein the toner shifting component and toner stirring component are free to rotate about the first and second annular hubs.

17. The toner cartridge according to claim 9 wherein one of the toner shifting component or toner stirring component has a magnet disposed thereon and the other has a ferrous material disposed thereon and wherein the magnet and ferrous material are oriented and positioned to attract one another.

18. The toner cartridge according to claim 9 wherein the toner shifting component comprises a first plurality of magnets disposed within and the toner stirring component comprises a second plurality of magnets disposed within and wherein the first and second plurality of magnets are oriented and positioned to attract one another.

19. The toner cartridge according to claim 9 wherein the toner shifting component has an annular recess and wherein the toner stirring component has an annular recess.

20. The toner cartridge according to claim 19 wherein the partition has a first protrusion on a first side that corresponds to the annular recess on the toner shifting component and a second protrusion on a second side that corresponds to the annular recess on the toner stirring component and wherein the annular recesses of the toner shifting component and toner stirring component are free to rotate about the first and second dividing wall protrusions.

* * * * *